US010236653B2

(12) United States Patent
Qiao et al.

(10) Patent No.: US 10,236,653 B2
(45) Date of Patent: Mar. 19, 2019

(54) PICK AND PLACE CAP AND CONNECTOR ASSEMBLY

(71) Applicant: 3M INNOVATIVE PROPERTIES COMPANY, St. Paul, MN (US)

(72) Inventors: YunLong Qiao, Singapore (SG); Saujit Bandhu, Singapore (SG)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/067,690

(22) PCT Filed: Jan. 5, 2017

(86) PCT No.: PCT/US2017/012276
§ 371 (c)(1),
(2) Date: Jul. 2, 2018

(87) PCT Pub. No.: WO2017/123448
PCT Pub. Date: Jul. 20, 2017

(65) Prior Publication Data

US 2019/0020164 A1 Jan. 17, 2019

Related U.S. Application Data

(60) Provisional application No. 62/277,011, filed on Jan. 11, 2016.

(51) Int. Cl.
*H01R 13/44* (2006.01)
*H01R 43/20* (2006.01)
*H01R 43/02* (2006.01)

(52) U.S. Cl.
CPC ..... *H01R 43/205* (2013.01); *H01R 43/0263* (2013.01)

(58) Field of Classification Search
CPC ..... H01R 13/447; H01R 43/205
(Continued)

(56) References Cited

U.S. PATENT DOCUMENTS 7,661,968 B1 * 2/2010 Duan ..... H01R 13/2442 439/135
7,946,865 B1 * 5/2011 Lai ..... H01R 43/205 439/135

(Continued)

FOREIGN PATENT DOCUMENTS

CN 2713672 Y 7/2005
JP H09-232064 9/1997

OTHER PUBLICATIONS

PCT International Search Report from PCT/US2017/012276 dated Mar. 29, 2017, 5 pages.

*Primary Examiner* — Phuong Chi T Nguyen
(74) *Attorney, Agent, or Firm* — Jonathan L. Tolstedt

(57) ABSTRACT

A pick and place cap is configured to facilitate picking and placing a connector when the cap is assembled to the connector. The cap includes a first wall defining a width, W, and a length, L of the cap. A second wall extends perpendicularly from the first wall and defines a height, H, of the cap. The cap also includes spaced apart parallel first, second, and third ribs extending from the first and second walls. Each of the first, second, and third ribs have the same first width, W1, and the same first height, H1. The first width and first height are less than the respective width and height of the cap. The cap includes spaced apart parallel fourth and fifth ribs disposed between and parallel to the second and third ribs. The fourth and fifth ribs are spaced part from the second wall and extend from the first wall. Each of the fourth and fifth ribs have the same second height, H2, which is greater than the first height, H1. Each of the fourth and fifth
(Continued)

ribs have the same second width, W2, which is less than the first width, W1.

24 Claims, 6 Drawing Sheets

(58) Field of Classification Search
USPC ..... 439/135, 940
See application file for complete search history.

(56) References Cited

U.S. PATENT DOCUMENTS

| | | | | |
|---|---|---|---|---|
| 2006/0128186 | A1 | 6/2006 | Li et al. | |
| 2007/0190831 | A1 * | 8/2007 | Shun ..... | H01R 43/0263 439/157 |
| 2007/0218722 | A1 | 9/2007 | Chen et al. | |

* cited by examiner

PICK AND PLACE CAP AND CONNECTOR ASSEMBLY

TECHNICAL FIELD

This disclosure relates generally to a pick and place cap for a connector and to connector assemblies that include a pick and place cap.

BACKGROUND

During the manufacture of electronic devices, some components are picked up from a magazine or tape and reel and placed on a circuit board to be soldered. During the pick and place operation the vacuum head of the pick and pack apparatus may apply suction to a surface of the component. However, some components do not have a suitable surface for the vacuum head. One alternative is to temporarily attach a cap to the component, so that the vacuum head attaches to the cap during the pick and place operation. The cap can then be removed after placement or soldering.

BRIEF SUMMARY

Some embodiments are directed to a pick and place cap configured to facilitate picking and placing a connector when the cap is assembled to the connector. The cap includes a first wall defining a width, W, and a length, L of the cap. A second wall extends perpendicularly from the first wall and defines a height, H, of the cap. The cap also includes spaced apart parallel first, second, and third ribs extending from the first and second walls. Each of the first, second, and third ribs have the same first width, W1, and the same first height, H1. The first width and first height are less than the respective width and height of the cap. The cap includes spaced apart parallel fourth and fifth ribs disposed between and parallel to the second and third ribs. The fourth and fifth ribs are spaced part from the second wall and extend from the first wall. Each of the fourth and fifth ribs have the same second height, H2, which is greater than the first height, H1. Each of the fourth and fifth ribs have the same second width, W2, which is less than the first width, W1.

According to some embodiments, a pick and place cap is configured to facilitate picking and placing a connector when assembled to the connector. The connector comprises coplanar discrete spaced apart first and second tongues extending forwardly from a base and defining a gap therebetween. Each of the first and second tongues are L-shaped and have a vertical portion next to the gap. Each of the first and second tongues include a horizontal portion extending from the vertical portion. A plurality of electrical contacts is disposed on the top surface of the horizontal portion. The cap includes a horizontal top portion having opposing front and rear edges and opposing first and second side edges. A vertical back portion of the cap extends downwardly from the back edge of the top portion. The vertical back portion has opposing first and second side edges. The cap further includes opposing parallel first and second endwalls extending downwardly and forwardly from the respective first side edges and second side edges of the top and back portions. A flange portion of the cap extends horizontally and forwardly from the front edge of the top portion. The cap includes spaced apart parallel first and second middle walls disposed between and parallel to the first and second endwalls. The first and second middle walls are spaced apart from the back portion and extend downwardly from the top portion beyond the first and second endwalls. A third middle wall of the cap is disposed between and parallel to the second endwall and the second middle wall and extends downwardly and forwardly from the top and back portions. When the cap is assembled to the connector the flange portion rests on the base of the connector, the first endwall rests on the first tongue, the second endwall and the third middle wall rest on the second tongue, and the first and second middle walls are disposed in the gap and extend downwardly beyond the horizontal portions of the first and second tongues and make contact with the respective vertical portions of the first and second tongues.

Some embodiments are directed to connector assembly that includes a connector and a pick and place cap. The connector includes a base and coplanar discrete spaced apart first and second tongues that extend forwardly from the base and define a gap therebetween. Each of the first and second tongues are L-shaped having a vertical portion next to the gap. A horizontal portion of the tongues extends from the vertical portion. A plurality of electrical contacts is disposed on a top surface of the horizontal portion. A pick and place cap is assembled to the connector and is configured to facilitate picking and placing of the connector. The cap includes a horizontal top portion and vertical back portion. The horizontal top portion faces a top side of the connector and has opposing front and rear edges and opposing first and second side edges. The vertical back portion faces a front side of the connector and extends downwardly from the back edge of the top portion and has opposing first and second side edges. A first endwall extends downwardly and forwardly from the first side edges of the top and back portions. A second endwall, opposite the first endwall, extends downwardly and forwardly from the second side edges of the top and back portions. A flange portion extends horizontally and forwardly from the front edge of the top portion and rests on a top surface of the base. Spaced apart parallel first and second middle walls are disposed between and parallel to the first and second endwalls. The first and second middle walls are spaced apart from the back portion and extend downwardly from the top portion beyond the first and second endwalls. The first and second middle walls are disposed in the gap and extend downwardly beyond the horizontal portions of the first and second tongues and make contact with the respective vertical portions of the first and second tongues. A third middle wall is disposed between and parallel to the second endwall and the second middle wall. The third middle wall extends downwardly and forwardly from the top and back portions. The third middle wall resting on the second tongue of the connector when the cap is assembled to the connector

BRIEF DESCRIPTION OF DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Some embodiments described herein are directed to a pick and place cap configured to facilitate picking and placing a connector when the cap is assembled to the connector. Features of the cap form a fictional fit with features of the connector that holds the cap to the connector during the pick and place process. The pick and place cap is configured to assemble to and/or disassemble from the connector along a height direction of the cap, e.g., along a direction that is perpendicular to the mating direction of the connector. Assembly/disassembly of the cap and connector along the direction perpendicular to the mating direction with a frictional fit enhances the pick and place process.

Figure 1:
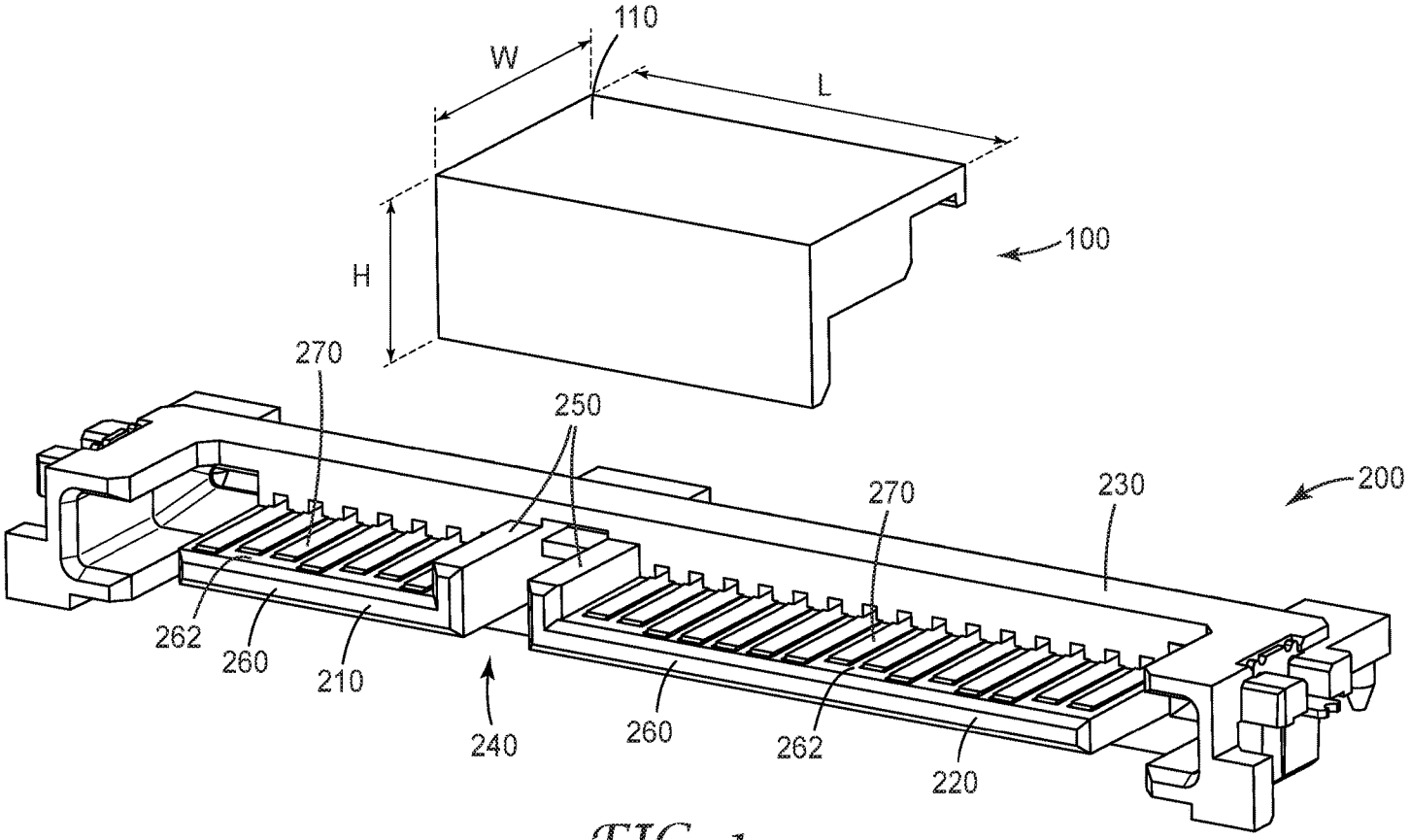
FIG. 1 shows a perspective view of a connector and a pick and place cap prior to assembling the cap to the connector in accordance with some embodiments.
Figure 2:
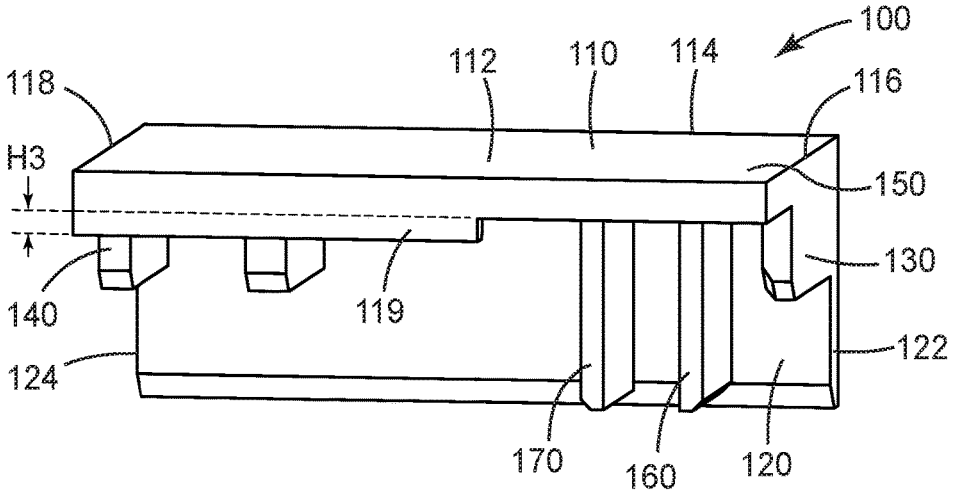
FIGS. 2 through 7 are various views of the cap of FIG. 1.

FIG. 1 illustrates a connector 200 and a cap 100 prior to assembling the cap 100 to the connector 200. FIG. 2 shows a perspective view of the cap 100. As illustrated in FIG. 1, the cap 100 includes a first wall 110 that defines a width, W, and a length, L, of the cap 100. A second wall 120 of the cap 100 extends perpendicularly from the first wall 110 and defines a height, H, of the cap 100.

The cap includes a plurality of ribs 140, 180, 130 that extend from the first and second walls 110, 120. First 140, second 180, and third 130 ribs are spaced apart and parallel to one another and extend from the first 110 and second 120 walls. Each of the first 140, second 180, and third 130 ribs have the same first width, W1, which is less than the width, W, of the cap 100. Each of the first 140, second 180, and third 130 ribs have the same first height, H1 which is less than the height, H, of the cap 100.

Figure 3:
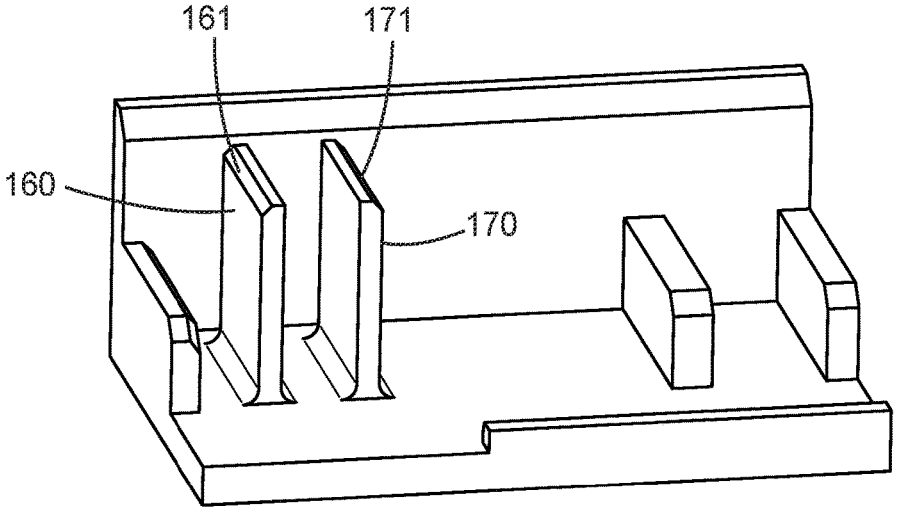

The cap 100 includes spaced apart and parallel fourth 170 and fifth 160 ribs disposed between and parallel to the second 180 and third 130 ribs. The fourth 170 and fifth 160 ribs extend from the first wall 110 and are spaced part from the second wall 120. Each of the fourth 170 and fifth 160 ribs have the same second height, H2, which is greater than the first height, H1. Each of the fourth 170 and fifth 160 ribs have the same second width, W2, which is less than the first width, W1. In some implementations, as shown in FIG. 3, each of the fourth 170 and fifth 160 ribs is chamfered on an outside edge 171, 161 of the rib 170, 160 parallel to the first wall 110 and away from the other rib 160, 170.

Figure 4:
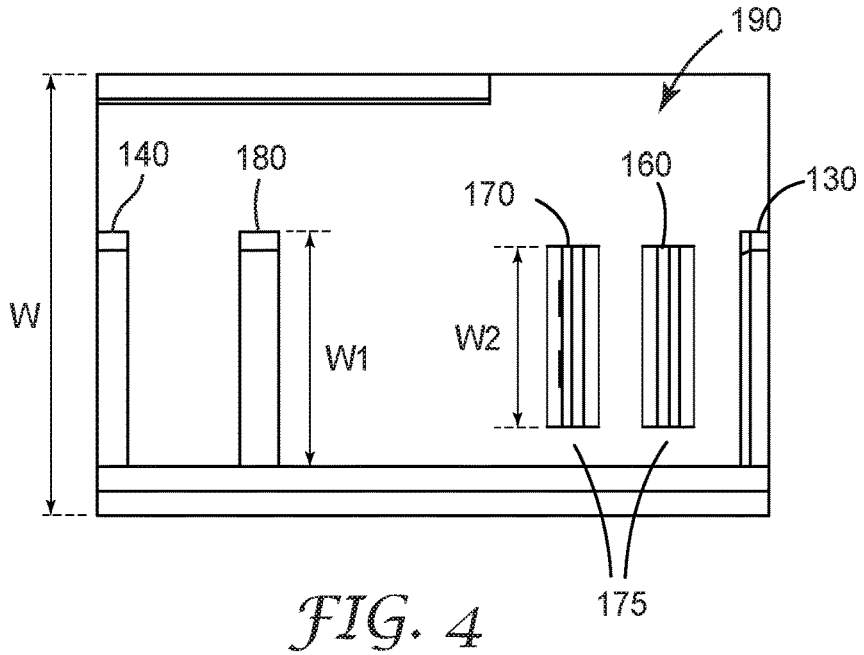
Figure 5:
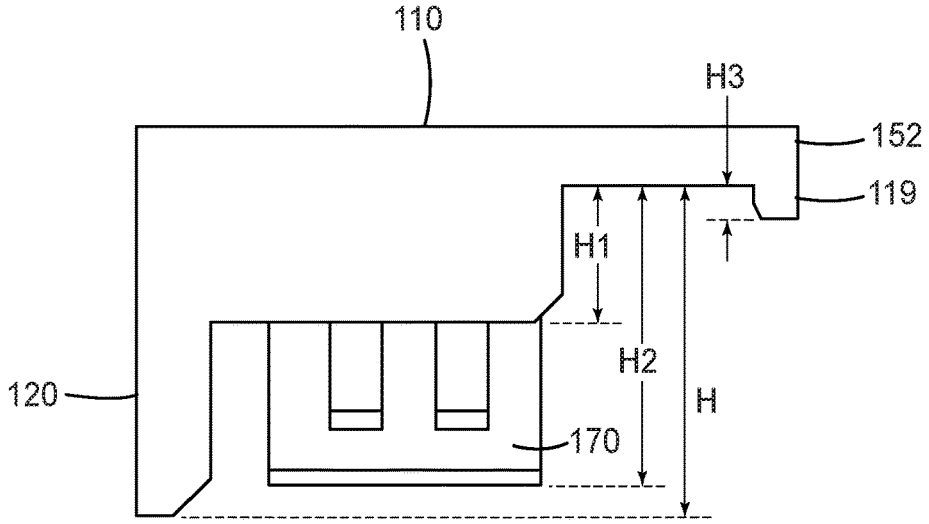
Figure 6:
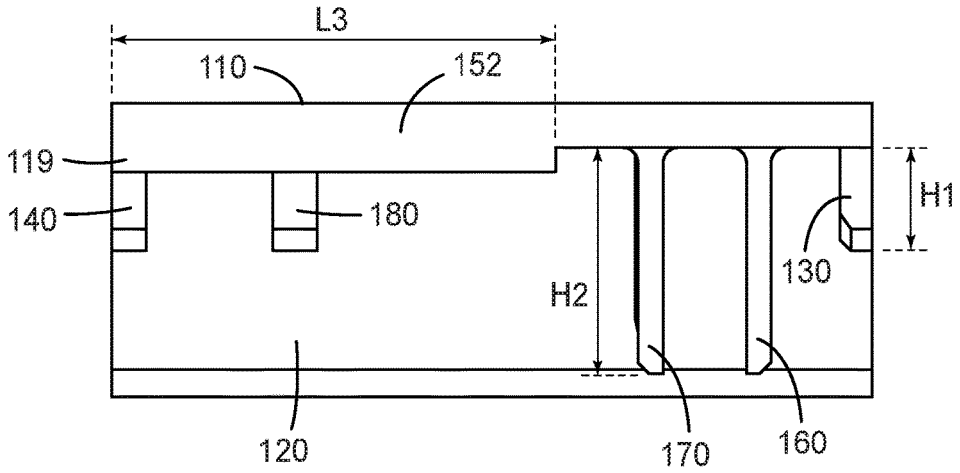

FIG. 4 shows a view of the cap 100 looking along an axis perpendicular to the first wall 110. FIG. 3 indicates the width, W, of the cap, the width, W1, of the first 140, second 180, and third 130 ribs, and the width, W2, of the fourth 170 and fifth 160 ribs. FIG. 5 shows a side view of the cap 100 and FIG. 6 shows view of the cap looking along an axis perpendicular to the second wall. FIGS. 5 and 6 indicates the height, H, of the cap, the height, H1, of the first 140, second 180, and third 130 ribs, and the height, H2, of the fourth 170 and fifth 160 ribs. In some embodiments $2H1<H<3H1$. In some embodiments, $1.5W1<W<2W1$. Each of the fourth 170 and fifth 160 ribs may be more flexible than each of the first 140, second 180, and third 130 ribs.

As best seen in FIGS. 2, 5, and 6 the cap 100 may include a third wall 119 extending perpendicularly from the first wall 110 and parallel to the second wall 120. The third wall 119 has a third height, H3, which is less than the first height, H1. The third wall 119 has a third length, L3 that is less than the length, L, of the cap 100. In some embodiments, $4H3<H1<5H3$. In some embodiments $L<2L3$.

Figure 8:
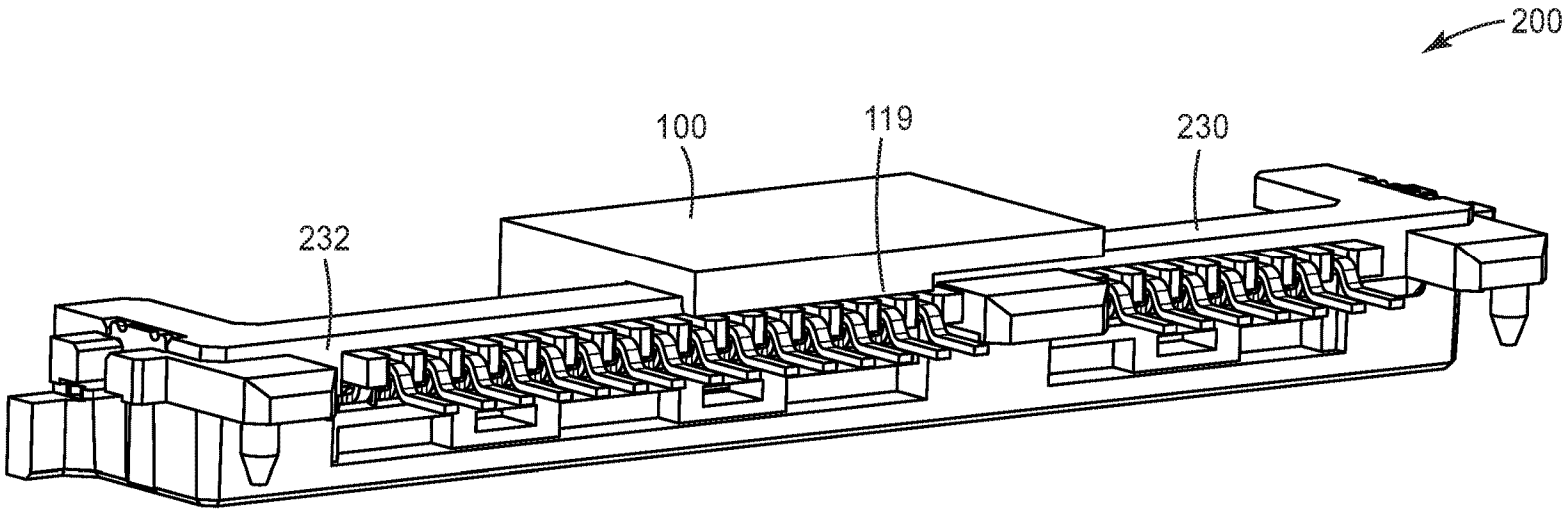
FIG. 8 is a perspective view showing a connector assembly comprising a pick and place cap assembled to a connector in accordance with some embodiments.

FIG. 8 provides a perspective view of a pick and place cap 100 assembled to a connector 200. The pick and place cap 100 is configured to facilitate picking and placing a connector 200 when assembled to the connector 200.

Referring to FIGS. 1 and 8, the connector 200 comprises coplanar discrete spaced apart first 210 and second 220 tongues extending forwardly from a base 230. The tongues 210, 220 and defining a gap 240 between the tongues. Each of the first 210 and second 220 tongues may be L-shaped and having a vertical portion 250 next to the gap 240 and a horizontal portion 260 extending from the vertical portion 250. A plurality of electrical contacts 270 is disposed on a top surface 262 of the horizontal portion 260 of the tongue 210, 220.

As shown in FIG. 2, the cap 100 includes a horizontal top portion 110 having opposing front 112 and rear 114 edges and opposing first 116 and second 118 side edges. The cap 100 includes a vertical back portion 120 that extends downwardly from the rear edge 114 of the top portion a100. The vertical back portion 120 has opposing first 122 and second 124 side edges and opposing parallel first 130 and second 140 endwalls that extend downwardly and forwardly from the respective first side edges 122 and second side edges 124 of the top 110 and back 120 portions;

The cap comprises a flange portion 150 that extends horizontally and forwardly from the front edge 112 of the top portion 110. Spaced apart and parallel first 160 and second 170 middle walls are disposed between and parallel to the first 130 and second 140 endwalls. The first 160 and second 170 middle walls are spaced apart from the back portion 120. The first 160 and second 170 middle walls extend downwardly from the top portion 110 beyond the first 130 and second 140 endwalls. A third middle wall 180 is disposed between and parallel to the second endwall 140 and the second middle wall 170. The third middle wall 180 extends downwardly and forwardly from the top 110 and back 120 portions.

Figure 9:
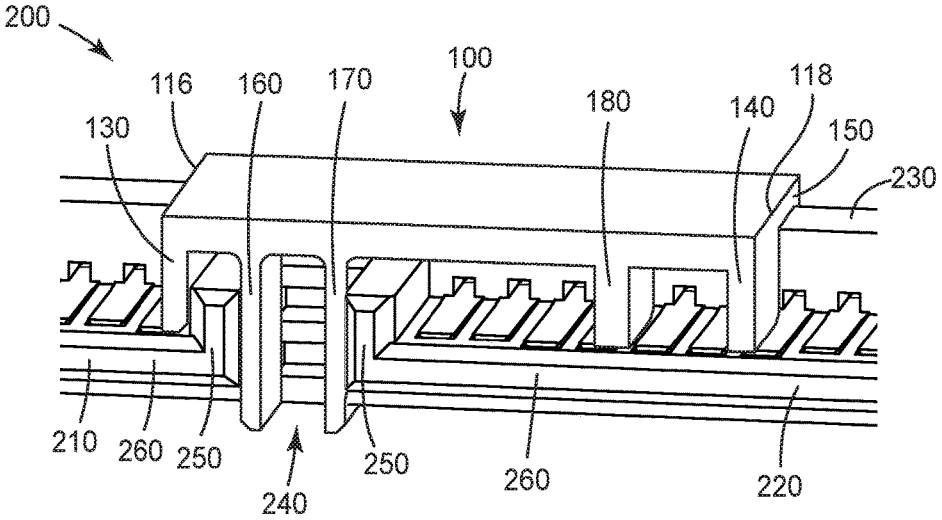
FIG. 9 is a cutaway view of the connector assembly of FIG. 8.

FIG. 9 shows a cut away view of the cap 100 assembled to a connector 200. When the cap 100 is assembled to the connector 200, the flange portion 150 rests on the base 230 of the connector 200. The first endwall 130 rests on the first tongue 210. The second endwall 140 and the third middle wall 180 rest on the second tongue 220. The first 160 and second 170 middle walls are disposed in the gap 240. The first 160 and second 170 middle walls extend downwardly beyond the horizontal portions 260 of the first 210 and second 220 tongues. The first 160 and second 170 middle walls make contact with the respective vertical portions 250 of the first 210 and second 220 tongues.

In some embodiments, each of the top 110 and back 120 portions of the cap 100 is substantially rectangular when viewed in a direction normal to the portion 110, 120. Each of the first 130 and second 140 endwalls may be substantially rectangular when viewed in a direction normal to the endwall 130, 140. Additionally, the flange portion 150 may be substantially rectangular when viewed in a direction normal to the flange. Each of the first 160, second 170, and third 180 middle wall may be substantially rectangular when viewed in a direction normal to the middle wall.

As best seen in FIG. 4, each of the first 160 and second 170 middle walls defines a gap 175 between the middle wall 160, 170 and the back portion 120 that extends along the entire middle wall to the top portion 110.

Figure 7:
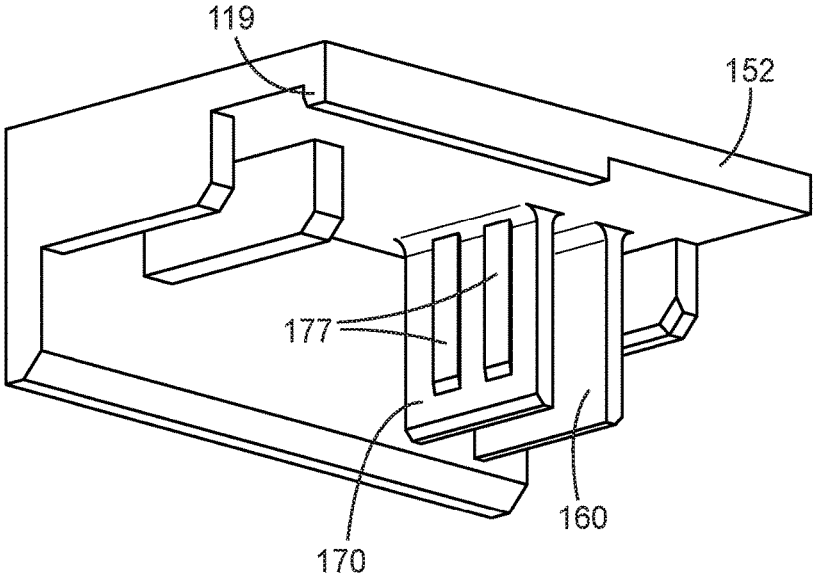

In some embodiments, as shown in FIG. 7, at least one of the first 160 and second 170 middle walls comprises an elongate protrusion 177 disposed on a major surface of the middle wall 160, 170. The protrusion 177 of the first middle wall 160 extends away from the second middle wall 170. The protrusions 177 of the first middle wall 160 are configured to frictionally engage the vertical portion 250 of the tongue 210 corresponding to the first middle wall 160. The protrusion 177 of the second middle wall 170 extends away from the first middle wall 160. The protrusions 177 of the second middle wall 170 are configured to frictionally engage the vertical portion 250 of the tongue 220 corresponding to the second middle wall 170.

The pick and place cap 100 can include an elongate lip 119, shown in FIGS. 5 through 8, disposed at and extending partially along a front edge 152 of flange portion 150. When the cap 100 is assembled to the connector 200 (see FIGS. 8 and 9, for example), the flange portion 150 rests on the base 230 of the connector 200 and the lip 119 rests on a back side 232 of the base 230.

Figure 10:
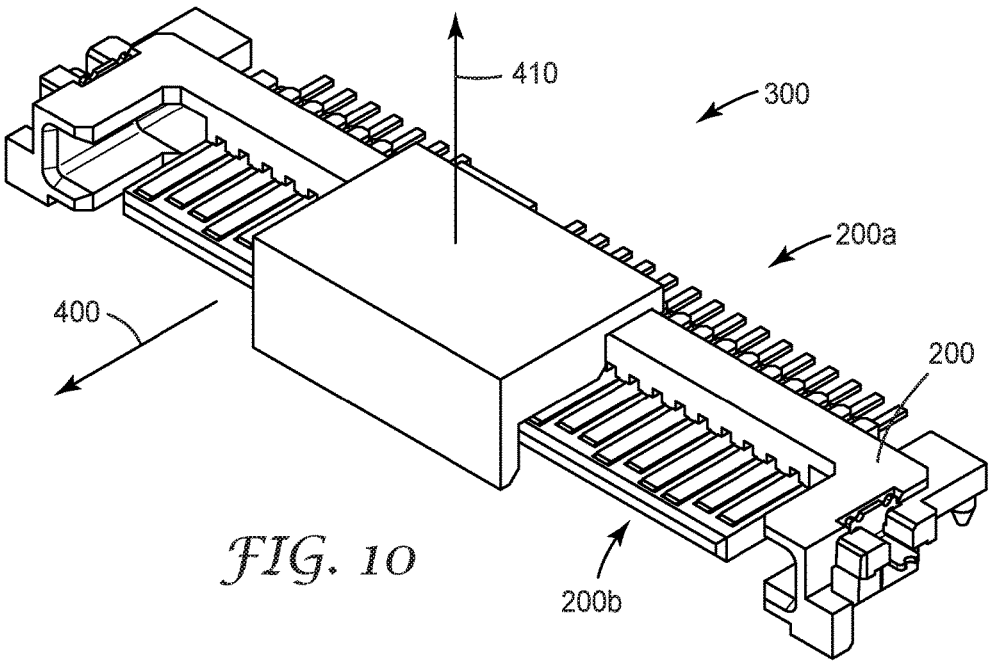
FIG. 10 is view of the connector assembly of FIG. 8 illustrating the assembly/disassembly direction of the pick and place cap in accordance with some embodiments.

FIG. 10 shows a connector assembly 300 that includes a cap 100 and a connector 200. Referring now to FIGS. 1 and 10, the connector 200 includes a base 230 and coplanar discrete spaced apart first 210 and second 220 tongues that extend forwardly from the base 230. A gap 240 is defined between the first 210 and second 220 tongues. Each of the first 210 and second 220 tongues can be L-shaped having a vertical portion 250 next to the gap 240. The first 210 and second 220 tongues have a horizontal portion 260 that extends from the vertical portion 250. A plurality of electrical contacts 270 are disposed on a top surface 262 of the horizontal portion 260 of each tongue 210, 220.

As shown in FIGS. 1 and 10, the pick and place cap 100 may be assembled to the connector 200. The pick and place cap 100 is facilitates picking and placing of the connector 200. The cap 100 includes a horizontal top portion 110 facing a top side 200*a* of the connector 200. As illustrated in FIG. 2, the top portion 110 of the cap 100 has opposing front 112 and rear 114 edges and opposing first 116 and second 118 side edges. The cap 100 also includes a vertical back portion 120 facing a front side 200*b* of the connector 200. The vertical back portion 120 extends downwardly from the back edge of the top portion 110. The vertical back portion 120 includes opposing first 122 and second 124 side edges.

Returning now to FIG. 2, the first endwall 130 of the cap 100 extends downwardly and forwardly from the first side edge 116 of the top portion and the first side edge 122 of the back portion 120. The second 140 endwall is opposite the first endwall 130 and extends downwardly and forwardly from the second side edge 118 of the top portion and the second side edge 124 of the back portion 120. The cap 100 has a flange portion 150 that extends horizontally and forwardly from the front edge 112 of the top portion 110 and rests on a top surface of the base 230 when assembled to the connector 200.

As illustrated in FIG. 2, the cap 100 includes spaced apart first 160 and second 170 middle walls that are parallel to one another. The first 160 and second 170 middle walls are disposed between and parallel to the first 130 and second 140 endwalls. The first 160 and second 170 middle walls are spaced apart from the back portion by a distance and extend downwardly from the top portion 110 beyond the first 130 and second 140 endwalls. As shown in FIG. 9, for example, when the cap 100 is assembled to the connector 200, the first 160 and second 170 middle walls are disposed in the gap 240 and extend downwardly beyond the horizontal portions 260 of the first 210 and second 220 tongues. In the connector assembly 300, the first 160 and second 170 make contact with the respective vertical portions 250 of the first 210 and second 220 tongues. The third middle wall 180 of the cap 100 is disposed between and parallel to the second endwall 140 and the second middle wall 170. The third middle wall 180 extends downwardly and forwardly from the top 110 and back 120 portions of the cap 100. When the cap 100 is assembled to the connector 200, the third middle wall 180 rests on the second tongue 220.

As illustrated in FIG. 10, the connector 200 is configured to mate with a mating connector along a mating direction 400. The pick and place cap 100 is assembled to and disassembled from the connector 200 along a first direction 410 perpendicular to the mating direction 400. The first direction 410 is a height direction of the cap 100. When the cap 100 is assembled to the connector, at least one of the first 160 and second 170 middle walls frictionally engages the vertical portion 250 of the tongue 210, 220 corresponding to the middle wall 160, 170. As shown in FIG. 3, each of the first 160 and second 170 middle walls is chamfered on an outside edge 161, 171 of the middle wall 160, 170 parallel to the top portion 110 and away from the other middle wall 170, 160 to facilitate the assembly of the pick and place cap 100 to the connector 200. When the cap 100 is assembled to the connector 200, at least one of the first 160 and second 170 middle walls flexes toward the other one of the first 160 and second 170 middle walls.

Items described in this disclosure include:

Item 1. A pick and place cap configured to facilitate picking and placing a connector when the cap is assembled to the connector, the cap comprising:

a first wall defining a width, W, and a length, L of the cap;

a second wall extending perpendicularly from the first wall and defining a height, H, of the cap;

spaced apart parallel first, second, and third ribs extending from the first and second walls, each having a same first width, W1, and a same first height, H1, less than the respective width and height of the cap; and spaced apart parallel fourth and fifth ribs disposed between and parallel to the second and third ribs, spaced part from the second wall, and extending from the first wall, each having a same second height, H2, greater than the first height, H1, and a same second width, W2, less than the first width, W1.

Item 2. The pick and place cap of item 1, wherein each of the fourth and fifth ribs is more flexible than each of the first, second and third ribs.

Item 3. The pick and place cap of any of items 1 through 2, wherein $2H1<H<3H1$.

Item 4. The pick and place cap of any of items 1 through 3, wherein $1.5W1<W<2W1$.

Item 5. The pick and place cap of any of items 1 through 4, further comprising a third wall extending perpendicularly from the first wall and parallel to the second wall and having a third height, H3, less than the first height, H1, and a third length, L3, less than the length, L, of the cap.

Item 6. The pick and place cap of item 5, wherein $4H3<H1<5H3$.

Item 7. The pick and place cap of item 5, wherein $L<2L3$.

Item 8. The pick and place cap of any of items 1 through 7 configured to assemble to a connector along a height direction of the cap.

Item 9. The pick and place cap of any of items 1 through 8, wherein each of the fourth and fifth ribs is chamfered on an outside edge of the rib parallel to the first wall and away from the other rib.

Item 10. A pick and place cap configured to facilitate picking and placing a connector when assembled to the connector, the connector comprising coplanar discrete spaced apart first and second tongues extending forwardly from a base and defining a gap therebetween, each of the first and second tongues being L-shaped and having a vertical portion next to the gap, a horizontal portion extending from the vertical portion, and a plurality of electrical contacts disposed on a top surface of the horizontal portion, the cap comprising:

a horizontal top portion having opposing front and rear edges and opposing first and second side edges;

a vertical back portion extending downwardly from the back edge of the top portion and having opposing first and second side edges;

opposing parallel first and second endwalls extending downwardly and forwardly from the respective first side edges and second side edges of the top and back portions;

a flange portion extending horizontally and forwardly from the front edge of the top portion;

spaced apart parallel first and second middle walls disposed between and parallel to the first and second endwalls, spaced apart from the back portion, and extending downwardly from the top portion beyond the first and second endwalls; and a third middle wall disposed between and parallel to the second endwall and the second middle wall and extending downwardly and forwardly from the top and back portions, such that when the cap is assembled to the connector:

the flange portion rests on the base of the connector;

the first endwall rests on the first tongue;

the second endwall and the third middle wall rest on the second tongue; and the first and second middle walls are disposed in the gap and extend downwardly beyond the horizontal portions of the first and second tongues and make contact with the respective vertical portions of the first and second tongues.

Item 11. The pick and place cap of item 10, wherein each of the top and back portions is substantially rectangular when viewed in a direction normal to the portion.

Item 12. The pick and place cap of any of items 10 through 11, wherein each of the first and second endwalls is substantially rectangular when viewed in a direction normal to the endwall.

Item 13. The pick and place cap of any of items 10 through 12, wherein the flange portion is substantially rectangular when viewed in a direction normal to the flange.

Item 14. The pick and place cap of any of items 10 through 13, wherein each of the first, second and third middle wall is substantially rectangular when viewed in a direction normal to the middle wall.

Item 15. The pick and place cap of any of items 10 through 14, wherein each of the first and second middle walls defines a gap between the middle wall and the back portion that extends along the entire middle wall to the top portion.

Item 16. The pick and place cap of any of items 10 through 15, wherein at least one of the first and second middle walls comprises an elongate protrusion disposed on a major surface thereof away from the other middle wall, the protrusion configured to frictionally engage the vertical portion of the tongue corresponding to the middle wall.

Item 17. The pick and place cap of any of items 10 through 16 further comprising an elongate lip disposed at and extending partially along a front edge of flange portion, such that when the cap is assembled to the connector, the flange portion rests on the base of the connector and the lip rests on a back side of the base.

Item 18. The pick and place cap of any of items 10 through 17, wherein the connector is configured to mate with a mating connector along a mating direction, and wherein the pick and place cap is configured to assemble to and disassemble from the connector along a first direction perpendicular to the mating direction.

Item 19. The pick and place cap of any of items 10 through 18, wherein when the cap is assembled to the connector, at least one of the first and second middle walls frictionally engages the vertical portion of the tongue corresponding to the middle wall.

Item 20. The pick and place cap of any of items 10 through 19, wherein each of the first and second middle walls is chamfered on an outside edge of the middle wall parallel to the top portion and away from the other middle wall to facilitate the assembly of the pick and place cap to the connector.

Item 21. The pick and place cap of any of items 10 through 20, wherein when the cap is assembled to the connector, at least one of the first and second middle walls flexes toward the other one of the first and second middle walls.

Item 22. A connector assembly comprising:

a connector comprising:

a base;

coplanar discrete spaced apart first and second tongues extending forwardly from the base and defining a gap therebetween, each of the first and second tongues being L-shaped having a vertical portion next to the gap, a horizontal portion extending from the vertical portion, and a plurality of electrical contacts disposed on a top surface of the horizontal portion; and a pick and place cap assembled to the connector and configured to facilitate picking and placing of the connector, the cap comprising:

a horizontal top portion facing a top side of the connector and having opposing front and rear edges and opposing first and second side edges;

a vertical back portion facing a front side of the connector and extending downwardly from the back edge of the top portion and having opposing first and second side edges;

a first endwall extending downwardly and forwardly from the first side edges of the top and back portions;

a second endwall, opposite the first endwall, extending downwardly and forwardly from the second side edges of the top and back portions;

a flange portion extending horizontally and forwardly from the front edge of the top portion and resting on a top surface of the base;

spaced apart parallel first and second middle walls disposed between and parallel to the first and second endwalls, spaced apart from the back portion, and extending downwardly from the top portion beyond the first and second endwalls, the first and second middle walls disposed in the gap and extending downwardly beyond the horizontal portions of the first and second tongues and making contact with the respective vertical portions of the first and second tongues; and a third middle wall disposed between and parallel to the second endwall and the second middle wall and extending downwardly and forwardly from the top and back portions, the third middle wall resting on the second tongue.

Item 23. The connector assembly of item 22, wherein the connector is configured to mate with a mating connector along a mating direction, and wherein the pick and place cap is assembled to and disassembled from the connector along a first direction perpendicular to the mating direction.

Item 24. The connector assembly of any of items 22 through 23, wherein at least one of the first and second middle walls is flexed toward the other one of the first and second middle walls.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. A pick and place cap configured to facilitate picking and placing a connector when the cap is assembled to the connector, the cap comprising:

a first wall defining a width, W, and a length, L of the cap;

a second wall extending perpendicularly from the first wall and defining a height, H, of the cap;

spaced apart parallel first, second, and third ribs extending from the first and second walls, each having a same first width, W1, and a same first height, H1, less than the respective width and height of the cap; and spaced apart parallel fourth and fifth ribs disposed between and parallel to the second and third ribs, spaced part from the second wall, and extending from the first wall, each having a same second height, H2, greater than the first height, H1, and a same second width, W2, less than the first width, W1.

2. The pick and place cap of claim 1, wherein each of the fourth and fifth ribs is more flexible than each of the first, second and third ribs.

3. The pick and place cap of claim 1, wherein $2H1<H<3H1$.

4. The pick and place cap of claim 1, wherein $1.5W1<W<2W1$.

5. The pick and place cap of claim 1 configured to assemble to a connector along a height direction of the cap.

6. The pick and place cap of claim 1, wherein each of the fourth and fifth ribs is chamfered on an outside edge of the rib parallel to the first wall and away from the other rib.

7. The pick and place cap of claim 1 further comprising a third wall extending perpendicularly from the first wall and parallel to the second wall and having a third height, H3, less than the first height, H1, and a third length, L3, less than the length, L, of the cap.

8. The pick and place cap of claim 7, wherein $4H3<H1<5H3$.

9. The pick and place cap of claim 7, wherein $L<2L3$.

10. A pick and place cap configured to facilitate picking and placing a connector when assembled to the connector, the connector comprising coplanar discrete spaced apart first and second tongues extending forwardly from a base and defining a gap therebetween, each of the first and second tongues being L-shaped and having a vertical portion next to the gap, a horizontal portion extending from the vertical portion, and a plurality of electrical contacts disposed on a top surface of the horizontal portion, the cap comprising:

a horizontal top portion having opposing front and rear edges and opposing first and second side edges;

a vertical back portion extending downwardly from the back edge of the top portion and having opposing first and second side edges;

opposing parallel first and second endwalls extending downwardly and forwardly from the respective first side edges and second side edges of the top and back portions;

a flange portion extending horizontally and forwardly from the front edge of the top portion;

spaced apart parallel first and second middle walls disposed between and parallel to the first and second endwalls, spaced apart from the back portion, and extending downwardly from the top portion beyond the first and second endwalls; and a third middle wall disposed between and parallel to the second endwall and the second middle wall and extending downwardly and forwardly from the top and back portions, such that when the cap is assembled to the connector:

the flange portion rests on the base of the connector;

the first endwall rests on the first tongue;

the second endwall and the third middle wall rest on the second tongue; and the first and second middle walls are disposed in the gap and extend downwardly beyond the horizontal portions of the first and second tongues and make contact with the respective vertical portions of the first and second tongues.

11. The pick and place cap of claim 10, wherein each of the top and back portions is substantially rectangular when viewed in a direction normal to the portion.

12. The pick and place cap of claim 10, wherein each of the first and second endwalls is substantially rectangular when viewed in a direction normal to the endwall.

13. The pick and place cap of claim 10, wherein the flange portion is substantially rectangular when viewed in a direction normal to the flange.

14. The pick and place cap of claim 10, wherein each of the first, second and third middle wall is substantially rectangular when viewed in a direction normal to the middle wall.

15. The pick and place cap of claim 10, wherein each of the first and second middle walls defines a gap between the middle wall and the back portion that extends along the entire middle wall to the top portion.

16. The pick and place cap of claim 10, wherein at least one of the first and second middle walls comprises an elongate protrusion disposed on a major surface thereof away from the other middle wall, the protrusion configured to frictionally engage the vertical portion of the tongue corresponding to the middle wall.

17. The pick and place cap of claim 10 further comprising an elongate lip disposed at and extending partially along a front edge of flange portion, such that when the cap is assembled to the connector, the flange portion rests on the base of the connector and the lip rests on a back side of the base.

18. The pick and place cap of claim 10, wherein the connector is configured to mate with a mating connector along a mating direction, and wherein the pick and place cap is configured to assemble to and disassemble from the connector along a first direction perpendicular to the mating direction.

19. The pick and place cap of claim 10, wherein when the cap is assembled to the connector, at least one of the first and second middle walls frictionally engages the vertical portion of the tongue corresponding to the middle wall.

20. The pick and place cap of claim 10, wherein each of the first and second middle walls is chamfered on an outside edge of the middle wall parallel to the top portion and away from the other middle wall to facilitate the assembly of the pick and place cap to the connector.

21. The pick and place cap of claim 10, wherein when the cap is assembled to the connector, at least one of the first and second middle walls flexes toward the other one of the first and second middle walls.

22. A connector assembly comprising:

a connector comprising:

a base;

coplanar discrete spaced apart first and second tongues extending forwardly from the base and defining a gap therebetween, each of the first and second tongues being L-shaped having a vertical portion next to the gap, a horizontal portion extending from the vertical portion, and a plurality of electrical contacts disposed on a top surface of the horizontal portion; and a pick and place cap assembled to the connector and configured to facilitate picking and placing of the connector, the cap comprising:

a horizontal top portion facing a top side of the connector and having opposing front and rear edges and opposing first and second side edges;

a vertical back portion facing a front side of the connector and extending downwardly from the back edge of the top portion and having opposing first and second side edges;

a first endwall extending downwardly and forwardly from the first side edges of the top and back portions;

a second endwall, opposite the first endwall, extending downwardly and forwardly from the second side edges of the top and back portions;

a flange portion extending horizontally and forwardly from the front edge of the top portion and resting on a top surface of the base;

spaced apart parallel first and second middle walls disposed between and parallel to the first and second endwalls, spaced apart from the back portion, and extending downwardly from the top portion beyond the first and second endwalls, the first and second middle walls disposed in the gap and extending downwardly beyond the horizontal portions of the first and second tongues and making contact with the respective vertical portions of the first and second tongues; and a third middle wall disposed between and parallel to the second endwall and the second middle wall and extending downwardly and forwardly from the top and back portions, the third middle wall resting on the second tongue.

23. The connector assembly of claim 22, wherein the connector is configured to mate with a mating connector along a mating direction, and wherein the pick and place cap is assembled to and disassembled from the connector along a first direction perpendicular to the mating direction.

24. The connector assembly of claim 22, wherein at least one of the first and second middle walls is flexed toward the other one of the first and second middle walls.

* * * * *